US010724176B2

(12) United States Patent
Carstensen

(10) Patent No.: US 10,724,176 B2
(45) Date of Patent: Jul. 28, 2020

(54) SYSTEMS AND METHODS FOR PROVIDING SHAPED VACUUM PORTS FOR FLUID EXTRACTION VACUUM BOX COVERS IN PAPERMAKING SYSTEMS

(71) Applicant: Kadant Inc., Westford, MA (US)

(72) Inventor: Peter Thuroe Carstensen, Adirondack, NY (US)

(73) Assignee: Kadant Inc., Westford, MA (US)

( * ) Notice: Subject to any disclaimer, the term of this patent is extended or adjusted under 35 U.S.C. 154(b) by 0 days.

(21) Appl. No.: 16/022,462

(22) Filed: Jun. 28, 2018

(65) Prior Publication Data

US 2019/0003116 A1 Jan. 3, 2019

Related U.S. Application Data

(60) Provisional application No. 62/526,093, filed on Jun. 28, 2017.

(51) Int. Cl.

| | |
|---|---|
| ***D21F 5/14*** | (2006.01) |
| ***D21F 1/52*** | (2006.01) |
| ***D21F 7/12*** | (2006.01) |

(52) U.S. Cl.

CPC ..... *D21F 5/14* (2013.01); *D21F 1/523* (2013.01); *D21F 7/12* (2013.01)

(58) Field of Classification Search

USPC ..... 162/363, 374

See application file for complete search history.

(56) References Cited

U.S. PATENT DOCUMENTS

| | | | | |
|---|---|---|---|---|
| 1,216,861 | A | 2/1917 | Shorey et al. | |
| 1,534,854 | A * | 4/1925 | Lewis | D21F 1/523 162/374 |
| 2,957,522 | A | 10/1960 | Gatke | |
| 3,053,319 | A | 9/1962 | Cronin et al. | |
| 4,011,131 | A | 3/1977 | Nicholson | |
| 4,909,906 | A | 3/1990 | Bartelmuss et al. | |
| 5,147,508 | A | 9/1992 | Sweet | |
| 8,557,086 | B2 * | 10/2013 | Eronen | D21F 1/523 162/374 |
| 2007/0144699 | A1 * | 6/2007 | McPherson | D21F 1/523 162/374 |
| 2019/0003116 | A1 | 1/2019 | Carstensen et al. | |

FOREIGN PATENT DOCUMENTS

| | | |
|---|---|---|
| FR | 2637622 A1 | 4/1990 |
| GB | 1118290 A | 6/1968 |

OTHER PUBLICATIONS

International Search Report & Written Opinion issued by International Searching Authority in related International Patent Application PCT/US2018/040128 dated Oct. 8, 2018, 12 pgs.

(Continued)

*Primary Examiner* — Mark Halpern
(74) *Attorney, Agent, or Firm* — Gesmer Updegrove LLP

(57) ABSTRACT

A system is disclosed for removing fluids from a felt in a paper making process. The system includes a vacuum source for providing a vacuum adjacent a vacuum plate against the felt is moved, and crescent shaped openings in the vacuum plate through which the vacuum is applied to the felt for the removal of the fluids.

13 Claims, 7 Drawing Sheets

(56) References Cited

OTHER PUBLICATIONS

International Preliminary Report on Patentability issued by the International Bureau of WIPO dated Dec. 31, 2019 in related International Application No. PCT/US2018/040128, 8 pages.
International Search Report & Written Opinion issued by International Searching Authority in related International Application No. PCT/US2018/040132 dated Oct. 10, 2018, 14 pages.
International Preliminary Report on Patentability issued by the International Bureau of WIPO dated Dec. 31, 2019 in related International Application No. PCT/US2018/040132, 8 pages.
Communication pursuant to Rules 161(1) and 162 EPC issued by the European Patent Office dated Feb. 4, 2020 in related European Patent Application No. 18743302.4, 3 pages.

* cited by examiner rA < rB < rC < rD

SYSTEMS AND METHODS FOR PROVIDING SHAPED VACUUM PORTS FOR FLUID EXTRACTION VACUUM BOX COVERS IN PAPERMAKING SYSTEMS

PRIORITY

The present application claims priority to U.S. Provisional Patent Application Ser. No. 62/526,093 filed Jun. 28, 2017, the disclosure of which is hereby incorporated by reference in its entirety.

BACKGROUND

The invention generally relates to paper making systems and processes, and relates in particular, to systems and processes for facilitating the removal of fluids from papermaking material during paper making processes.

In the paper making process the press section is equipped with conveying belts commonly referred to as felts. The felts act to carry the newly formed, very wet paper to the pressing rolls where a considerable amount of water is forced out of the paper and into the felts. As these felts are serpentine in nature, it is necessary to remove the captured water from the felts so that the process of water removal from the paper is repeated as the continuous supply of newly form paper is processed through the press section.

The method presently in use today for water extraction from the serpentine felt involves the use of a vacuum element in the belt run commonly referred to as the fluid extraction box or Uhle box, which is typically constructed from a pipe or enclosure that has a contact wear surface attached to it. This contact wear surface incorporates within the design a through path for the vacuum applied water extraction stream to drain into. The vacuum applied to the felt is considerable and causes the felt to be pulled tightly onto the contact wear surface and into the vacuum port open area. This cover includes ports or pathways for the extracted water to be conveyed/evacuated to.

These vacuum application ports may be in various geometric configurations. Conventionally, the shape and open area of the port is sized for the vacuum exposure dwell time on the moving serpentine felt; dwell time that is too long wastes energy, too short does not allow enough time for the water to be fully extracted. Also, another design consideration is the slot (or opening) width, which has a direct correlation to felt wear and felt seam failure modes.

There remains a need however, for more efficient and effective systems for removing fluids from felts while minimizing wear on the felts.

SUMMARY

In accordance with an embodiment, the invention provides a system for removing fluids from a felt in a paper making process. The system includes a vacuum source for providing a vacuum adjacent a vacuum plate against the felt is moved, and crescent shaped openings in the vacuum plate through which the vacuum is applied to the felt for the removal of the fluids.

In accordance with another embodiment, the invention provides a method for removing fluids from a felt in a paper making process. The method includes the steps of providing a vacuum adjacent a vacuum plate, moving the felt against the vacuum plate, and providing vacuum to the felt through crescent shaped openings in the vacuum plate for the removal of the fluids.

In accordance with a further embodiment, the invention provides a system for removing fluids from a felt in a paper making process. The system includes a vacuum source for providing a vacuum through vacuum channels within a vacuum plate against the felt is moved, and variable sized openings in the vacuum plate in communication with the vacuum channels through which the vacuum is applied to the felt for the removal of the fluids.

BRIEF DESCRIPTION OF THE DRAWINGS

The following description may be further understood with reference to the accompanying drawings in which.

Figure 1:
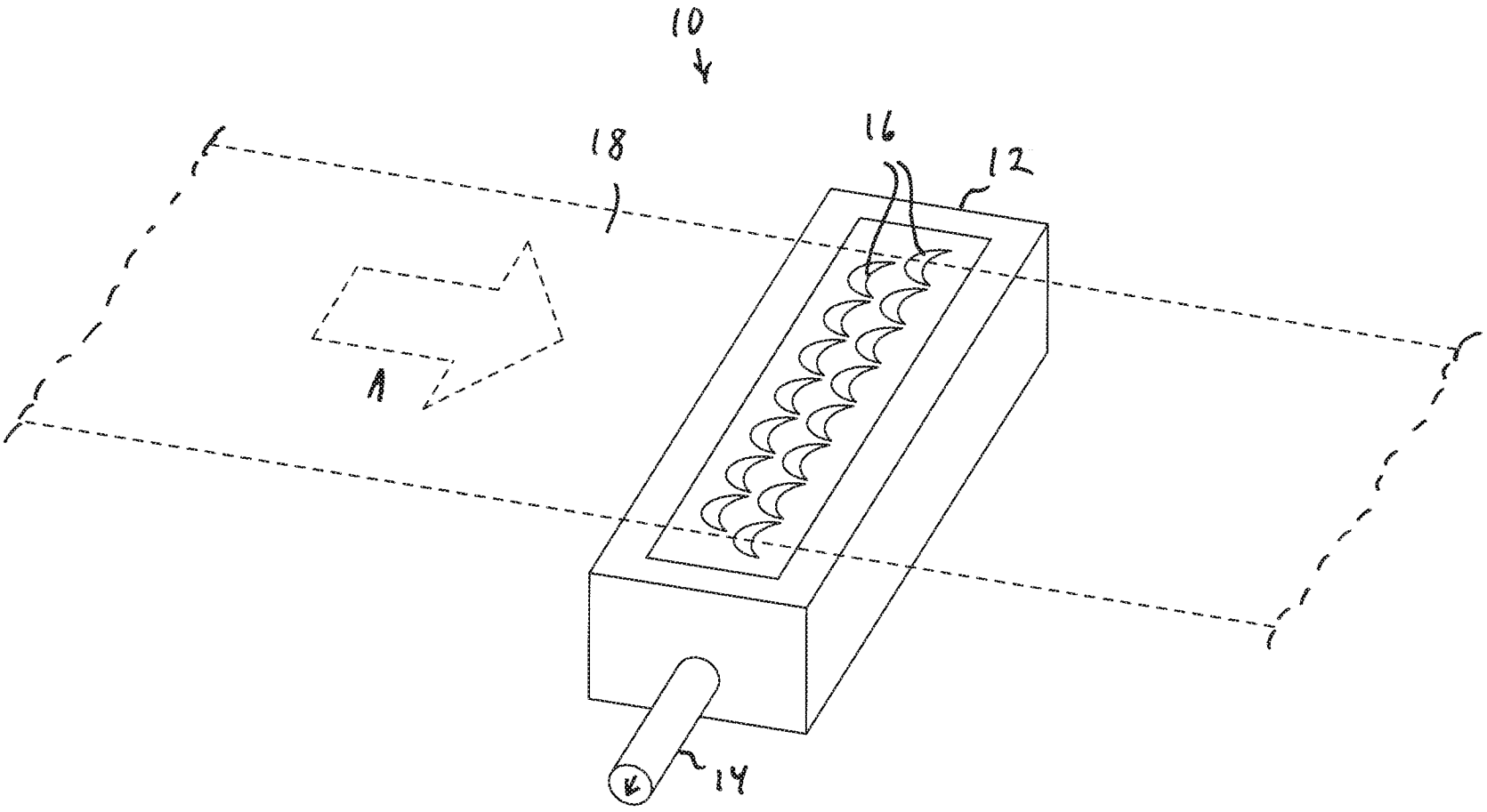
FIG. 1 shows an illustrative diagrammatic view of a fluid extraction box cover system in accordance with an embodiment of the present invention.

The drawings are shown for illustrative purposes only.

DETAILED DESCRIPTION

The vacuum application port design opening size and shape is a balance between efficient dewatering of the felt and felt damage/wear. The wear and inherent damage is due to the unsupported felt span over the applied vacuum port (opening). The size (width) of the vacuum port in the machine direction will cause varying degrees of catenary deflection of the felt. The felt deflection towards the vacuum source occurs as the differential pressure (1) atmosphere pressure on one side of the felt and the applied dewatering negative pressure (typically 15 hg-20 hg) on the other side of the felt.

Some manufactures have incorporated a multitude of narrow slots to achieve the dwell time required for the application and minimize the damaging catenary deflection. The open area must be consistent across the width of the machine or patterns occur, commonly called streaks that effect the paper quality. The use of narrow slots however, is problematic because they tend to fill with contaminates thus, becoming non-functional and may create a streaking phenomenon in the felt that will affect the paper quality negatively.

In accordance with various embodiments, vacuum ports having a unique crescent shape may be provided with the through flow rake angle to relieve this problem. It is to be noted that the extraction of water is the reverse of the flow into the felt as the paper is compressed in the press nip—that is, it is removed from the face (paper) side of the felt when the vacuum is applied to the felt at the fluid extraction box (Uhle box). In the past 20 years, paper production machines have nearly doubled in speed(s). At the present higher paper machine speeds, larger openings are required to develop the vacuum exposure dwell times needed to effectively dewater the felt(s). But as mentioned above, the larger the opening, the larger the catenary deflection. It is this catenary deflection felt angle traveling across the trailing opening edge of the vacuum port that causes excessive felt (paper side) surface wear. Manufacturers have addressed this problem by incorporating a radius on the same trailing edge to reduce the damaging effect.

An issue addressed is that this radii reduces the efficiency of the dewatering function by re-injecting the non-separated (paper side of the felt) water attached to the vacuum application side of the felt (meniscus adhesion phenomenon) back into the body of the felt due to the ramp of this radius at the trailing slot edge. The proposed crescent shaped slot and layout pattern addresses the vacuum dwell necessary to extract water efficiently and minimize catenary deflection/trailing edge felt wear and minimizes reinjection of unseparated water into the felt body.

Another issue addressed is the plugging that occurs in small vacuum port support spans (narrow slots). The unique port shape in concert with the through cover rake angle alleviates this problem. A further issue addressed is the high wear stresses that take place at the vacuum port trailing edges. This is addressed by manufacturing the Crescent vacuum port as a single component of higher wear properties and insert it into the contact wear surface.

In accordance with various embodiments of the invention, vacuum ports geometry is in the shape of what would be commonly known as a crescent. The crescent shape allows a very small degree of the underside felt doctoring reinjection effect in the high catenary deflection zone and virtually none in the low catenary deflection zone. The array of crescent shaped vacuum ports are laid out in a double, triple or quadruple etc. staggered pattern. The staggered pattern benefits the process of dewatering efficiently by (1) capturing any incidental "pooling" doctored reinjection fluid by the upstream vacuum ports and (2) maintain an even open area for the felt vacuum exposure dwell time.

FIG. 1 shows a system 10 in accordance with an embodiment of the present invention that includes a fluid extraction box 12 is coupled to a vacuum source 14 that provides vacuum to crescent shaped openings 16 in a vacuum plate of the vacuum box. As a felt 18 (shown in dashed lines) travels over the vacuum box in a direction as indicated at A, fluid (e.g., water) is drawn from the felt 18 through the crescent shaped openings 16. In accordance with various embodiments, the felt width and the width of the area of the combined openings 16 may be the same. Alternatively, if the width of the combined openings is wider than the felt, plates may be laid over exposed openings next to the felt to ensure that any openings not covered by the felt do not draw excessive vacuum. FIG. 1 shows the crescent shaped openings in a vacuum plate through which a vacuum is applied to the underside of a felt that is moving in a direction as shown by the arrow.

Figures 2, 3:
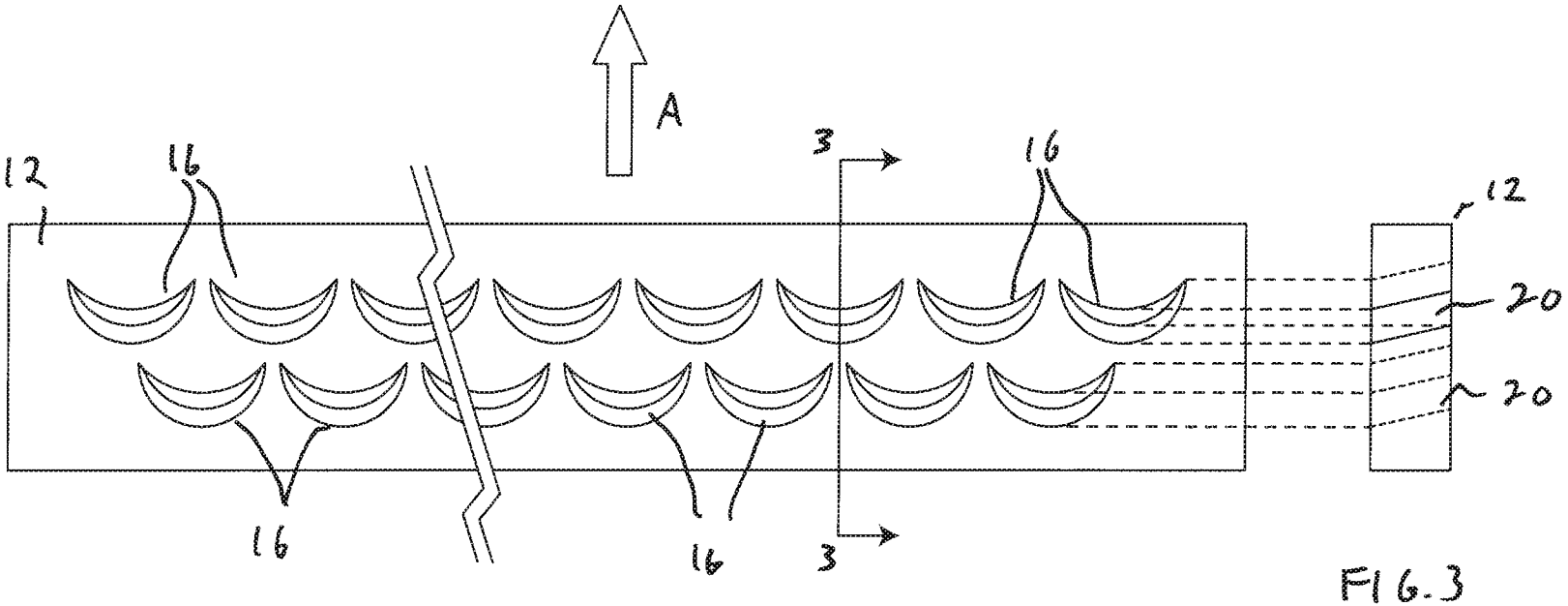
FIG. 2 shows an illustrative diagrammatic top view of a fluid extraction box cover in accordance with an embodiment of the present invention.
FIG. 3 shows an illustrative diagrammatic sectional view of the box cover of FIG. 2 taken along line 3-3 thereof.

FIG. 2 shows a top view of the vacuum box 12 in accordance with an embodiment of the present invention that employs two rows of crescent shaped openings 16. The openings 16 extend along the width of the vacuum box, and the leading edges of the crescent shaped openings extend in the direction of travel of the felt as indicated at A. Each of the openings 16 is in communication with a channel 20 in the vacuum plate, which channel leads to a common vacuum conduit. As shown in FIG. 3 (which is a sectional view of a portion of the vacuum box shown in FIG. 2 taken along line 3-3), the channels 20 are angled (raked) forward to facilitate the removal of fluid from the belt.

Figure 4A:
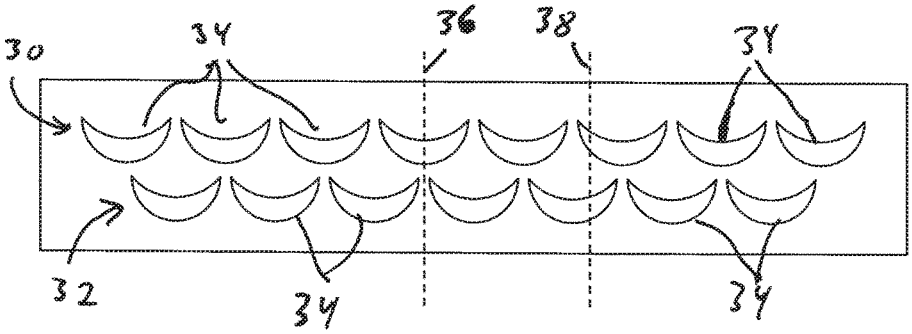
FIGS. 4A-4D show illustrative diagrammatic top views of patterned shaped layout of box covers in accordance with further embodiments of the present invention.
Figure 4B:
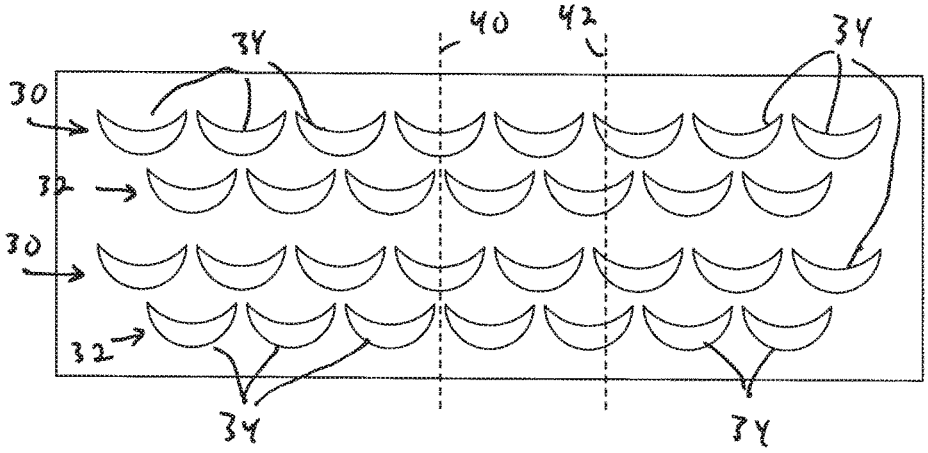

The openings 16 are optionally laid out in such a way that any line traversing the openings in the direction of travel of the felt is exposed to approximately the same amount of opening area. For example, FIG. 4A shows a vacuum cover with two rows 30, 32 of crescent shaped openings 34. The openings 34 are staggered in such a way that any set of parallel lines (e.g., 36, 38) passing the direction of travel of the felt will encounter that same amount of total vacuum opening area. Multiple sets of the rows 30, 32 may be provided as shown in FIG. 4B. Again, the openings 34 are staggered in such a way that any set of parallel lines (e.g., 40, 42) passing the direction of travel of the felt will encounter that same amount of total vacuum opening area. A benefit of such designs, is that although the total vacuum opening area is constant, each portion of the felt is always traveling over changing sizes of opening, facilitating the removal of fluid from the felt. The alternation of small opening (e.g., near a crescent tip) and large vacuum, with large opening (e.g., near the crescent center) and smaller vacuum, provide dynamic vacuum activity that facilitate removal of the fluid from the felt.

Figure 4C:
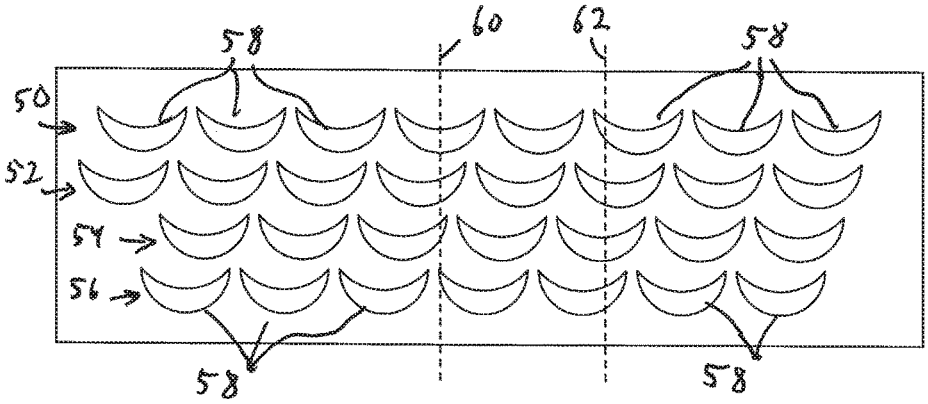
Figure 4D:
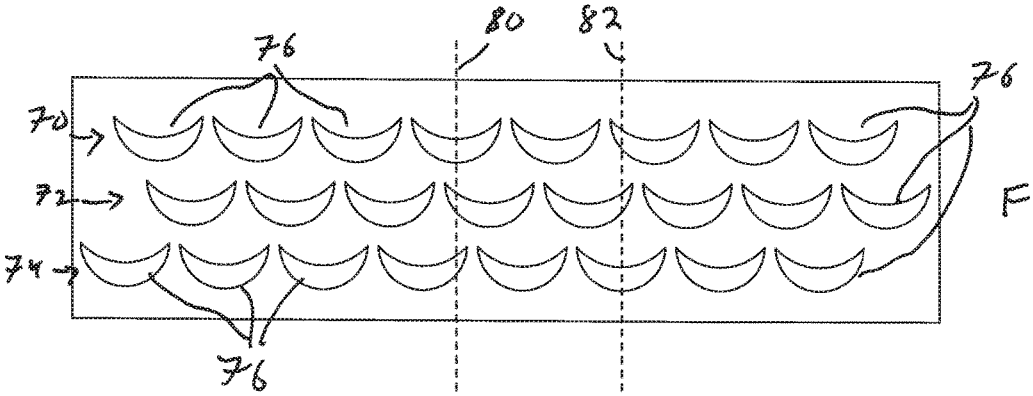

In accordance with further embodiments and with reference to FIG. 4C, a set of four rows 50, 52, 54, 56 of openings 58 may be provided that are staggered such that together they provide that any set of parallel lines (e.g., 60, 62) passing the direction of travel of the felt will encounter that same amount of total vacuum opening area across all rows of openings. Similarly, with reference to FIG. 4D, a set of three rows 70, 72, 74 of openings 76 may be provided that are staggered such that together they provide that any set of parallel lines (e.g., 80, 82) passing the direction of travel of the felt will encounter that same amount of total vacuum opening area across all rows of openings.

Figure 5A:
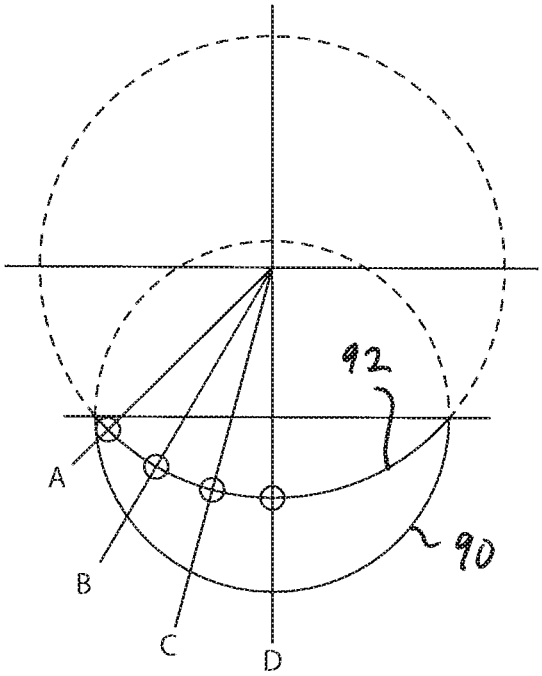
FIGS. 5A and 5B show an illustrative diagrammatic geometric representations of the radii defining a crescent shape and the variations in corner radii in a box cover in accordance with an embodiment of the present invention.
Figure 5B:
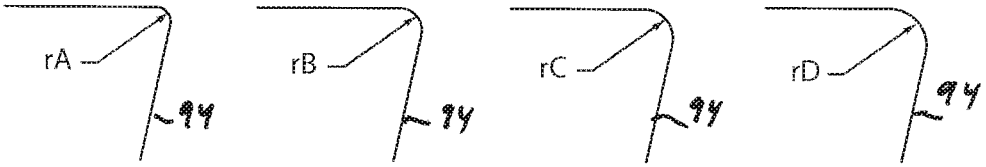

For example, a crescent shape may consist of a 1.5" arc and 2" arc with intersects at the 3" diameter horizontal centerline. The compensated open area is a consistent 0.75" in the felt run direction when the geometry is laid out as shown in FIG. 4A. Further open area geometric possibilities are attained with the use of further arc radii. The open area required by the process is a result of paper machine speed, felt permeability, temperature and available vacuum to the process. The desirable dwell time that the felt is exposed to the vacuum source is typically 2 ms-4 ms, thus a large degree of open area configurations exists per application. As additionally shown in FIG. 5A, the leading arc edge 92 of a crescent shape 90 may have a varying radii corner that leads to the angle channel. In particular, FIG. 5A shows such break radii at A, B, C and D, and FIG. 5B shows side views of such different radii corners (again, where the openings lead to the angled channels defined by channel walls 94).

The vacuum port felt contact trailing edges will therefore have a varying degree of break radii to insure no damaging effect to the felt that would be attributed to the catenary deflection yet provide minimal pooling reinjection. This type of port would allow for very small catenary deflection in the largest span and virtually none in the smallest span zones of the crescent port the break radii would be approximately <0.090" in the large span zone and <0.040" in the low span zone. In accordance with further embodiments, the varying degree of break radii may instead be provided by varying sized chamfers (decreasing towards the outer tips of the crescent.

As an added configuration detail systems may provide minimal reinjection conditions, by providing that the vacuum port, through the cover body, would be tilted (raked) back (as shown in FIG. 3) to alleviate any pooling effect that is prone to occur in present designs. Another manifestation of this complete geometry and a means of putting it in practice, is to have the vacuum port with all noted geometry manufactured as a single component insert. This insert could be of material different from the cover. This vacuum port insert, which is in the highest frictional stress(s), would be manufactured from a harder material.

Figure 6:
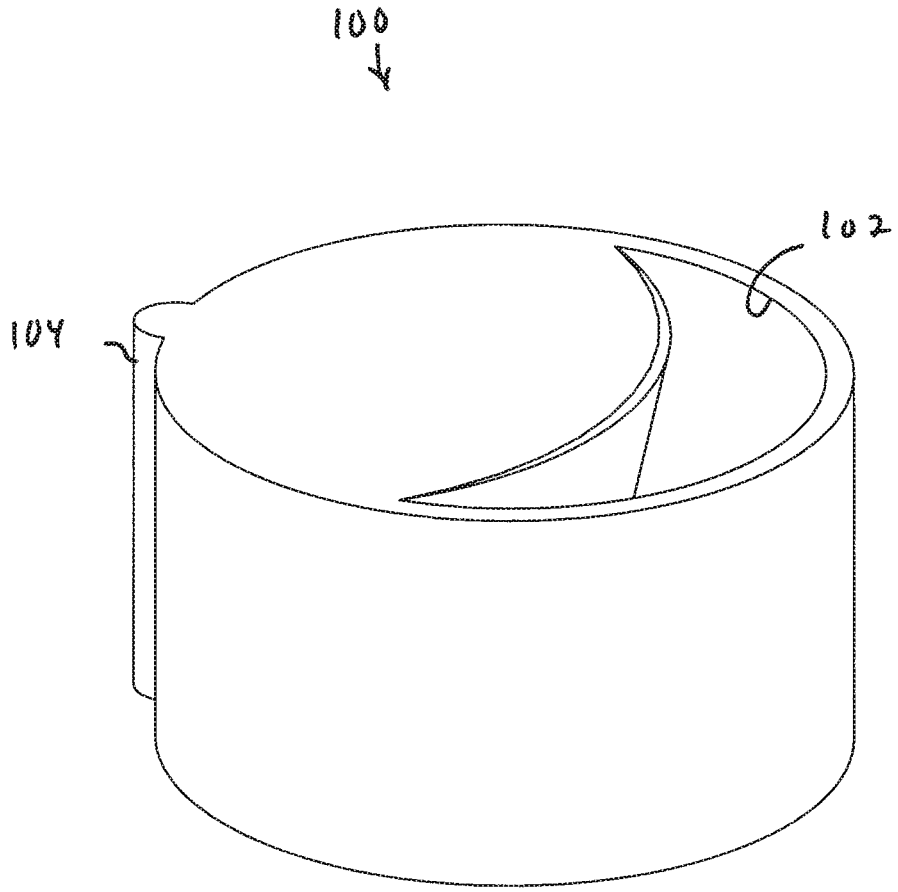
FIG. 6 shows an illustrative diagrammatic view of a crescent shaped opening insert for use in a box cover in accordance with an embodiment of the present invention.
Figure 7:
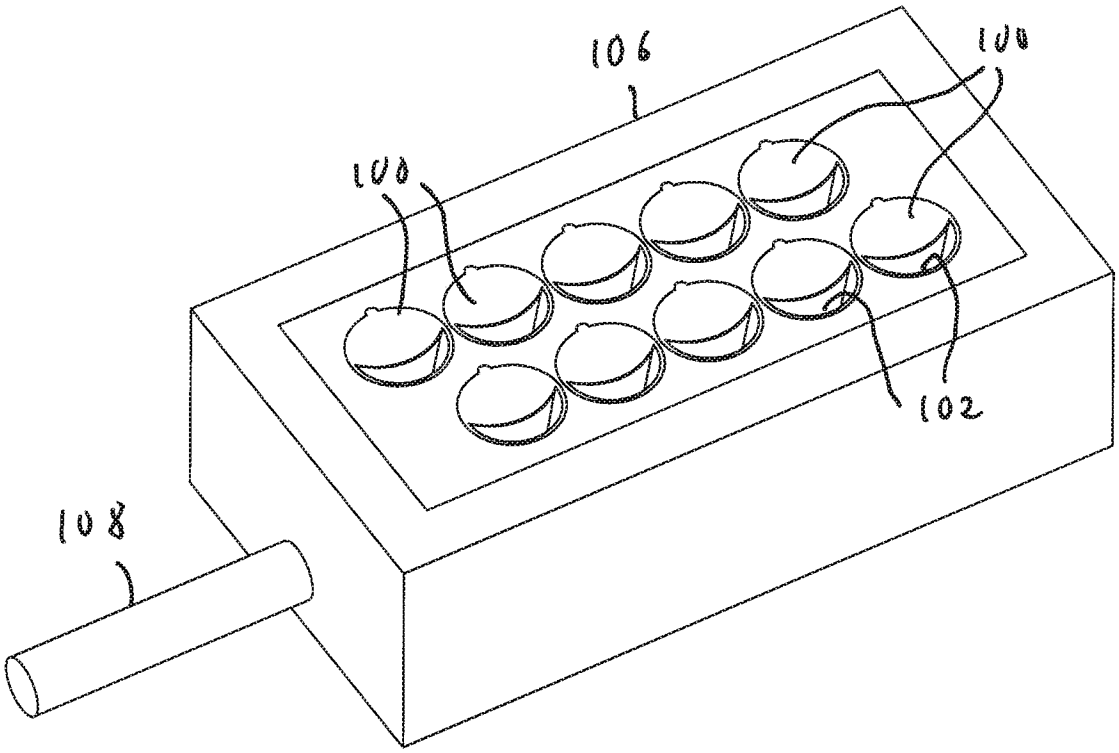
FIG. 7 shows an illustrative diagrammatic view of a box cover including crescent shaped opening inserts in accordance with an embodiment of the present invention.
Figures 8A, 8B:
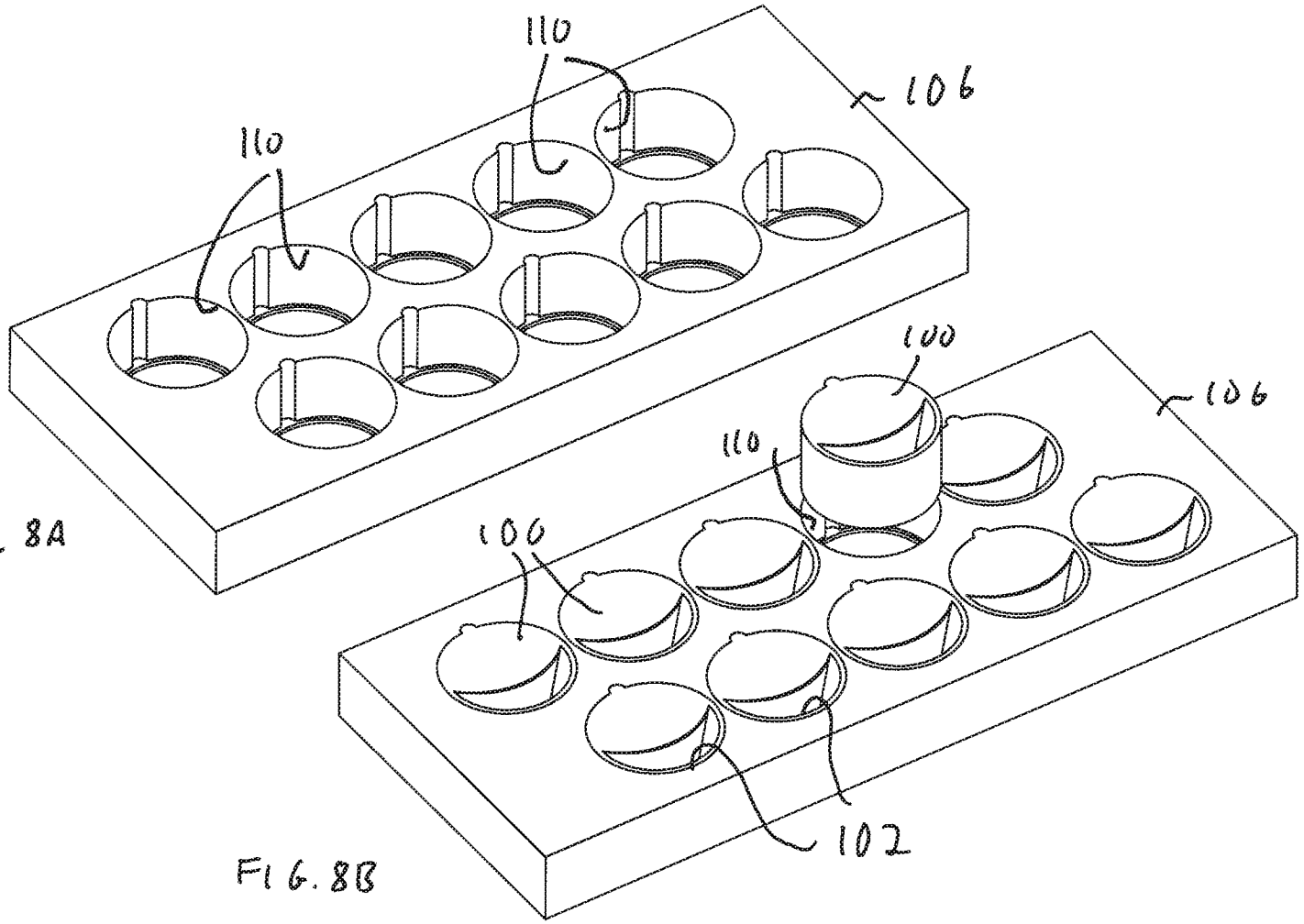
FIGS. 8A and 8B show illustrative diagrammatic views of the box cover of FIG. 7 both without the inserts (FIG. 8A) and with the inserts (FIG. 8B).

FIG. 6, for example, shows an isometric view of a vacuum plug 100 that includes a crescent shaped opening 102 for use in a vacuum plates in accordance with further embodiments of the present invention. The vacuum plug 100 may be formed of a material different than that of the vacuum plate, and may have an orientation key 104 to facilitate proper alignment of the vacuum plug 100 in a vacuum plate. FIG. 7, for example, shows a plurality of vacuum plugs 100 inserted into plug openings in a vacuum plate 106 that is coupled to a vacuum line 108. FIG. 8A shows the vacuum plate 106 without any vacuum plugs, showing the shaped recesses 110 into which the vacuum plugs are inserted, and FIG. 8B shows the vacuum plate 106 with the vacuum plugs inserted and one vacuum plug being inserted into a shaped recess.

In accordance with various embodiments, therefore, the systems and methods of the invention provide that a felt may undergo varying amounts of vacuum on an underside thereof, yet that each lineal section of the felt will undergo a similar amount of total vacuum area.

Those skilled in the art will appreciate that numerous modifications and variations may be made to the above disclosed embodiments without departing from the spirit and scope of the present invention.

What is claimed is:

1. A system for removing fluids from a felt in a paper making process, said system comprising a vacuum source for providing a vacuum adjacent a vacuum plate against the felt as the felt is moved over the vacuum plate, and crescent shaped openings in the vacuum plate through which the vacuum is applied to the felt for the removal of the fluids, wherein the crescent shaped openings are oriented such that the tips of the crescent shaped openings are directed along a direction of movement over the felt.

2. The system as claimed in claim 1, wherein the crescent shaped openings each include a first curved edge defined by a first radius, and a second curved edge defined by a second radius.

3. The system as claimed in claim 2, wherein the first curved edge is the leading edge of the crescent shaped opening and wherein the first radius is larger than the second radius.

4. The system as claimed in claim 3, wherein the first radius is approximately twice the second radius.

5. The system as claimed in claim 2, wherein the first curved edge includes rounded corners having varying radii along an arc of the first curved edge.

6. The system as claimed in claim 1, wherein a total opening area along a plurality of mutually parallel directions in the direction of movement of the felt over the vacuum plate provides a consistent amount of total open vacuum area.

7. A system for removing fluids from a felt in a paper making process, said system comprising a vacuum source for providing a vacuum through vacuum channels within a vacuum plate against the felt as the felt is moved in a direction over the vacuum plate, and arcuate shaped openings in the vacuum plate in communication with the vacuum channels through which the vacuum is applied to the felt for the removal of the fluids, each arcuate shaped opening having a leading concave edge and a trailing concave edge, and wherein the vacuum channels are angled towards the direction of movement of the felt.

8. The system as claimed in claim 7, wherein the arcuate shaped openings are oriented such that the tips of the arcuate shaped openings are directed along the direction of movement of the felt.

9. The system as claimed in claim 7, wherein the leading concave edge of the arcuate shaped openings are defined by a first radius, and the trailing concave edge of the arcuate shaped openings are defined by a second radius.

10. The system as claimed in claim 9, wherein the first radius is larger than the second radius.

11. The system as claimed in claim 10, wherein the first radius is approximately twice the second radius.

12. The system as claimed in claim 9, wherein the leading concave edge includes rounded corners having varying radii along an arc of the leading concave edge.

13. The system as claimed in claim 7, wherein a total opening area along a plurality of mutually parallel directions in the direction of movement of the felt over the vacuum plate provides a consistent amount of total open vacuum area.

* * * * *